US006073607A

United States Patent [19]

Liber

[11] Patent Number: 6,073,607

[45] Date of Patent: Jun. 13, 2000

[54] SPARK PLUG

[75] Inventor: Bruno B. Liber, London, Canada

[73] Assignee: BBL Technologies, Inc., Ontario, Canada

[21] Appl. No.: 09/135,674

[22] Filed: Aug. 18, 1998

[51] Int. Cl.[7] ..... F02P 13/00

[52] U.S. Cl. ..... 123/297; 123/150

[58] Field of Search ..... 123/151, 152, 123/150, 169 V, 297

[56] References Cited

U.S. PATENT DOCUMENTS

| | | | |
|---|---|---|---|
| 2,391,220 | 12/1945 | Beeh | 123/169 V |
| 3,195,158 | 7/1965 | Candelise | 123/169 V |
| 4,699,096 | 10/1987 | Phillips | 123/169 V |
| 4,864,989 | 9/1989 | Markley | 123/297 |
| 5,000,135 | 3/1991 | Taguma | 123/151 |
| 5,245,959 | 9/1993 | Ringenbach | 123/169 V |
| 5,497,744 | 3/1996 | Nagaosa et al. | 123/297 |
| 5,715,788 | 2/1998 | Tarr et al. | 123/297 |
| 5,730,100 | 3/1998 | Bergsten | 123/297 |

FOREIGN PATENT DOCUMENTS

| | | | |
|---|---|---|---|
| 0 632 198 | 1/1995 | European Pat. Off. | 123/297 |

*Primary Examiner*—Erick Solis
*Attorney, Agent, or Firm*—Roylance,Abrams,Berdo & Goodman, L.L.P.

[57] ABSTRACT

A spark plug includes an insulator body provided with a longitudinally-extending through bore. A one-piece, central electrode is secured within the longitudinally-extending through bore, while simultaneously providing an annular zone communicating with a combustion chamber. An earth lower electrode projects diametrically-inward towards the central electrode and is spaced a longitudinally-fixed distance beyond the lower end of the central electrode. A first, non-central longitudinally-extending bore in the insulator body is connected to a fuel metering device for controllably admitting fuel to the combustion chamber. A second, non-central, longitudinally-extending bore in the insulator body is connected between the combustion chamber and an exhaust manifold to exhaust gases from the combustion chamber. A lower-threaded base connects the spark plug to an opening in the combustion chamber.

14 Claims, 4 Drawing Sheets

SPARK PLUG

FIELD OF THE INVENTION

The present invention relates to a spark plug providing cleaner and more efficient combustion of all petroleum-based fuels in internal combustion engines and natural gas for furnaces.

BACKGROUND OF THE INVENTION

The NSP (New Spark Plug) comprises a normal steel or aluminum-made body, which is connected to an electronic system metering fuel and air supplies for combustion. Both elements are delivered by a normal fuel pump. The intake, at manifold conventional adjusted pressures, operates on electronic pulsations to allow fuel to be admitted through the synchro-fuel passage of 0.5 mm, bored also conventionally at 3°45'52" (degrees-minutes-seconds).

The vehicle engine computerizes the fuel system delivery and, by pulsations, injects the fuel directly to the NSP. Simultaneously, a synchronized pulsating electronic spark is transmitted to first to the central electrode, then to the body of the NSP.

The central electrode and the earth electrode are made of one single piece of 2 mm. wide, and 1 mm. thick of nickel-chrome. The electrode is bent toward the inside wall of the NSP.

This one piece, central and earth electrode, is one aspect of the present invention among the other NSP innovations.

NSP-85 as used herein, means that 85% of any fuel consumption is reduced in any vehicle, by connecting the fuel pump to a pressure reducing valve, whose pressure is obtained by restricting the flow to the low pressure circuit. As back pressure rises, the piston is moved and compresses the spring. The shape of the piston restricts the passage orifice.

Some engines dispense with the carburetor and substitute a compact computer producing a spark of 46,000 volts. A more precise fuel mixture is provided in a fuel-injection system.

The computer decides how much fuel is needed and meters the proper volume into a series of NSP. The new spark plugs, on further command from the computer, provided individual sprays for each cylinder directly without loosing volume, or pressure on its path. This reduces gas or fuel consumption by a maximum of 85% as compared to the carburetors or fuel injectors which waste, a single, voluminous spray for all cylinders at once. Only 18% of the fuel or gas is burned by any engine. The rest of the fuel is blown out into the air as raw polluting liquid causing smog, coming from every engine or vehicle around the globe. In the present invention, separate mixing of air and fuel takes place at the bottom of the spark plug, that is inside the bottom end of the NSP, with fuel-air synchronized by any normal computer of today's modern vehicles and, delivering this timed, just required volume of air-fuel, preventing smog pollution. Every time the driver steps on the gas pedal, the driver triggers a new series of computer calculations. The pedal opens a valve, comparable to the choke of a carburetor, that increases the volume of air entering the engines' spark plugs. The computer instantly reacts to the increased air-flow in the air duct comparing it to the temperatures of both the outgoing and incoming air.

It then calculates the proper fuel mixture and directs a spray of gasoline through the 0.3 or 0.5 mm orifice of the spark plug toward each cylinder. Combustion is virtually 100% efficient. The NSP as a consequence renders obsolete this injectors-nozzles, and carburetors.

A rotating reluctor and a magnetic pick-up coil replace the traditional cam-breaker points and condenser as well in the distributors of vehicles equipped for electronic ignition. This system reduces the time between tune-ups.

The high spots of the reluctor interrupt the magnetic field of the pick-up coil and the permanent magnet. These interruptions, or pulses, are transmitted form the pick-up to a nearby electronic control unit powered by a powerful all-electronic transformer which is capable of producing a spark up to 46,000 volts for a period of $^{2}/_{1,000,000}$th of a second. There, the pulses signal a transistor to break the low voltage sub-circuit, and release high-voltage, normally drawn in a modern vehicle electronic system of 25,000 volts, from the coil to the ignition of the spark plug. Hence, virtually zero emissions emirate from any vehicle or engine. This is further improved if that vehicle is also equipped with the NCC/M, the New Catalytic Converter/Muffler.

SUMMARY OF THE INVENTION

Objects of aspects of this invention are to provide a spark plug and fuel injection and ignition system to reduce air pollution due to internal combustion engines.

By one broad aspect, the present invention provides a spark plug which comprises: (a) an insulator body having a longitudinally-extending through bore; (b) a one-piece, central electrode secured within the longitudinally-extending through bore and providing an annular zone for communicating with a combustion chamber; (c) an earth lower electrode projecting diametrically-inwardly towards the central electrode and spaced a longitudinally-fixed distance beyond a lower end of the central electrode; (d) a first, non-central, longitudinally-extending bore within the insulator body for connection to a fuel metering device for controllably admitting fuel to the combustion chamber; (e) a second, non-central, longitudinally-extending bore within the insulator body for connection between the combustion chamber and an exhaust manifold to exhaust gases from the combustion chamber; and (f) a lower, threaded base for connection of the spark plug to an opening in the combustion chamber.

By one variant thereof, the insulator body is formed of porcelain, ceramic or mica.

By another variant thereof, the central electrode is formed of nichrome, of a piezzo-electric material, or of a platinum-group metal and may also include a lower end projecting diametrically outwardly.

By yet another variant thereof, the second lower earth electrode is formed of a platinum group metal.

By still another variant thereof, the lower threaded base is formed of aluminum and includes an upper copper gasket adjacent to the lower end of the insulator body.

By variations of this aspect and the variants described above, the combustion chamber is the combustion chamber of an internal combustion engine, e.g., where the volume of the combustion chamber is 467 to 900 $mm^3$, or the combustion chamber is a furnace.

By another aspect of this invention, an internal combustion engine has at least one cylinder having an intake valve, and a spark plug connected to each cylinder. The spark plug comprises: (a) an insulator body having a longitudinally-extending through bore; (b) a one-piece, central electrode secured within the longitudinally-extending through bore while simultaneously providing an annular zone communicating with a combustion chamber of the cylinder; (c) an earth lower electrode projecting towards the central electrode and spaced a longitudinally-fixed distance beyond an end of the central electrode; (d) a first, non-central, longitudinally-extending bore within the insulator body connected to a fuel metering device for controllably admitting fuel to the combustion chamber; (e) a second, non-central, longitudinally-extending bore within the insulator body connected between the combustion chamber and the exhaust manifold to exhaust gas from the combustion chamber; and (f) a lower-threaded base for connection of the spark plug to an opening in the combustion chamber. A computerized ignition control is connected to an exposed terminal of the central electrode. A computerized micro fuel pulsation delivery fuel line is connected to the first, non-central longitudinally-extending bore.

By one variant thereof, the computerized ignition control includes a distributor controlled by a computer which monitors manifold pressure, engine speed, engine temperature and air temperature. The electronic ignition can include a rotating reluctor and magnetic pick-up to produce central pulses.

By another variant thereof, the fuel injection system is specially constructed to provide a precise mixture of fuel and air to the fuel injection port of the park plug. Individual sprays of fuel/air mixture to the combustion chamber can then be provided without loosing volume and/or pressure in its path.

Other objects, advantages and salient features of the present invention will become apparent from the following detailed description, which, taken in conjunction with the annexed drawings, disclose a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
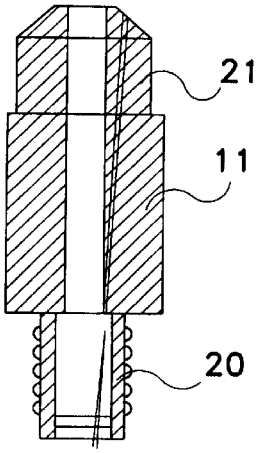
FIGS. 1 to 4 are side elevational views, in section of various stages during the assembly of a spark plug of an embodiment of the present invention.
Figure 2:
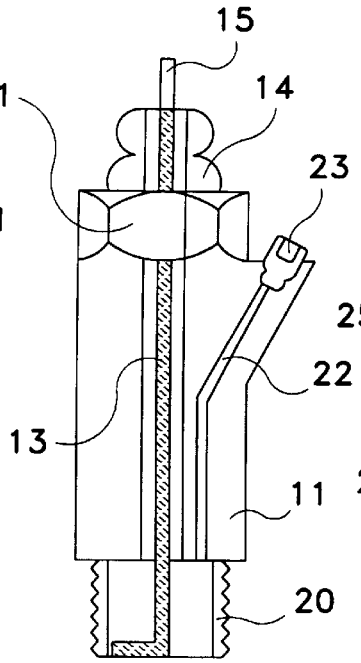
Figure 3:
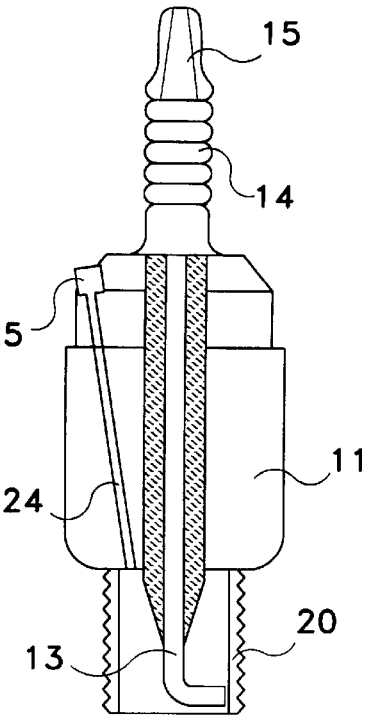
Figure 4:
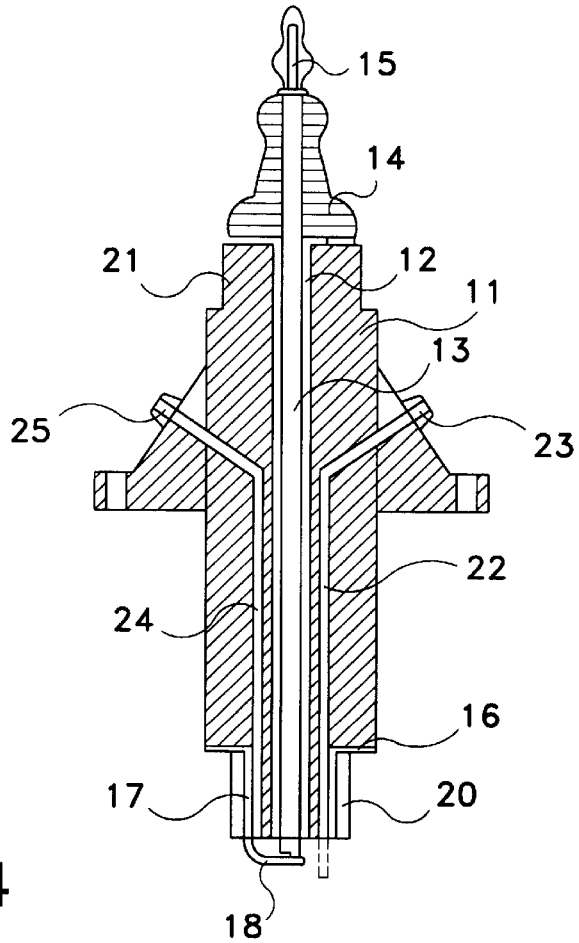

As seen in FIGS. 1 to 4, the spark plug 10, according to an embodiment of the present invention, includes a main cylindrical insulator body 11, formed of a porcelain, ceramic or mica, the body including a central longitudinal bore 12. Within the bore 12 is secured a central electrode 13 having an insulator cap 14 and a "hot" terminal connector pin. The central electrode is formed of a suitable conductor material, i.e., a conducting metal, e.g., aluminum or copper, or nichrome, or a piezzo-electric material or a platinum group metal, e.g., platinum, iridium, osmium, palladium, rhodium and ruthenium.

The base of the insulator body 11 includes an annular gasket 16 made of a suitable electrically-conductive metal, e.g., copper, or aluminum, which is integrally-connected to an earth electrode 17, which extends non-centrally downwardly and then inwardly to the central longitudinal axis, with its piece 18 spaced a fixed distance below the lower end of the central electrode 13.

Below the base of insulator body 11 is a main threaded base 20, formed of a suitable metal, e.g., aluminum. At the upper end of the insulator body 11 is an upper threaded cap 21, formed of a suitable metal, e.g., aluminum.

A first, non-central bore is provided in the insulator body 11 which extends angularly-outwardly to a connector 23. Connector 23 is coupled to a fuel inflow metering system to be described later, which is fed in Venturi flow. Bore 22 extends below the base 20 to be in fluid communication with the cylinder of the internal combustion engine (to be described later).

A second, non-central bore 24 is provided in the insulator body 11 which extends angularly outwardly to a connection 25. Bore 24 extends below the base 20 to be in fluid communication with the cylinder of the internal combustion engine. Bore 24 then communicates via connector 25 to an exhaust manifold, flowing in Venturi flow (to be described later).

This new spark plug reduces fuel consumption (any fuel), by 85% at will and is tune-up-adjusted, computerized and distributed, according to the combustion chamber dimensions. Also, this NSP will produce a spark of 46,000 volts, therefore burning substantially all droplets of any fuel, and substantially eliminating pollution and smog.

Figure 5:
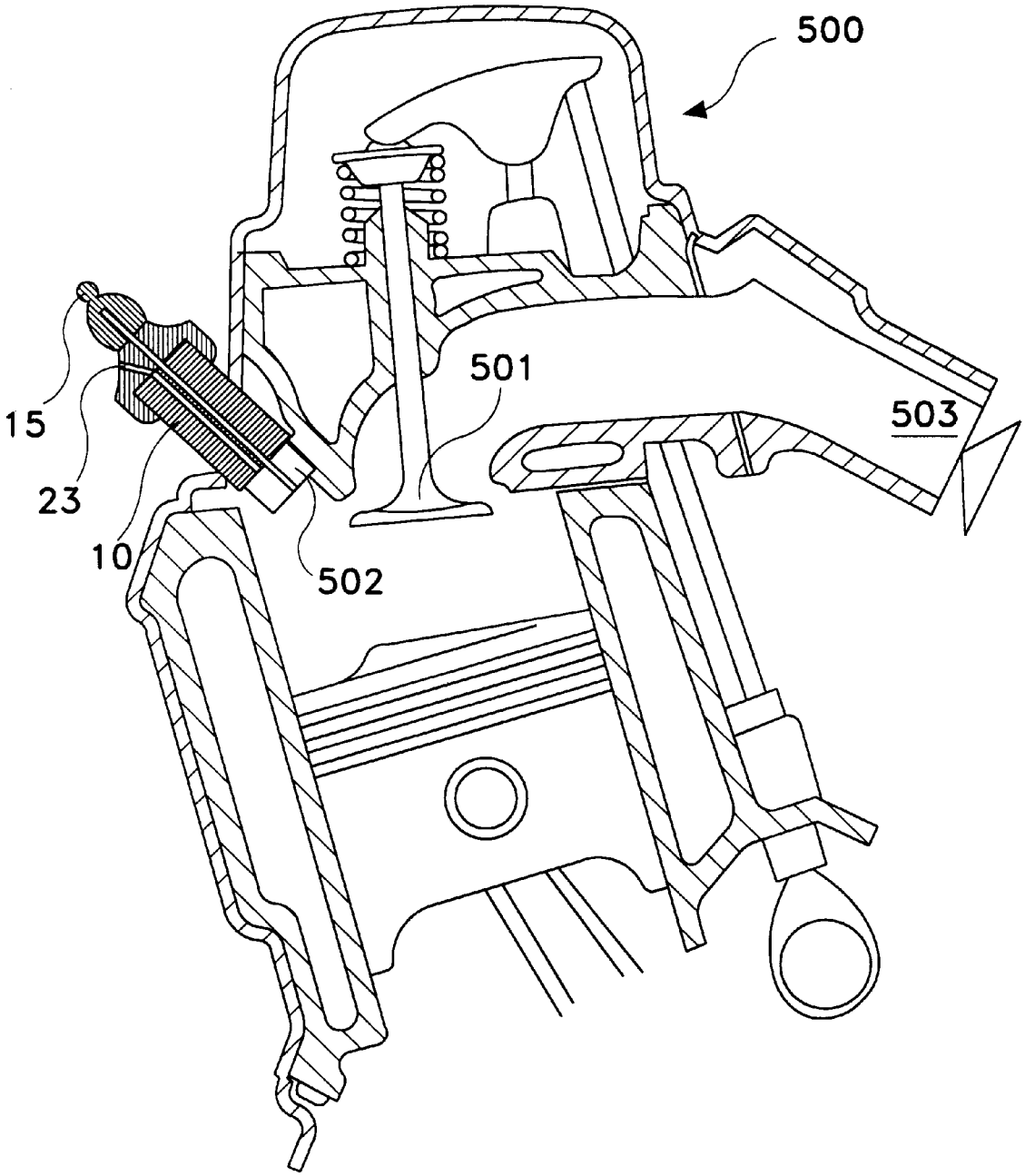
FIG. 5 is a side elevational view in section of the combination of a cylinder of an internal combustion engine with a spark plug of FIGS. 1 to 4.

As seen in FIG. 5, the internal combustion engine cylinder 500 is fitted with an intake valve 501. The combustion chamber 502 generally has a volume of 597 $mm^3$. The intake manifold 503 is fed with combustion-supporting air, controlled by a computer, as will be described in FIG. 6.

Spark plug 10 is fitted onto the upper reaches of the combustion chamber 502. Connector 23 is connected to the computerized micro-fuel pulsation delivery system as will be described in FIG. 6. Terminal connector pin 15 is connected to the computerized ignition system as will be described in FIG. 6.

Figure 6:
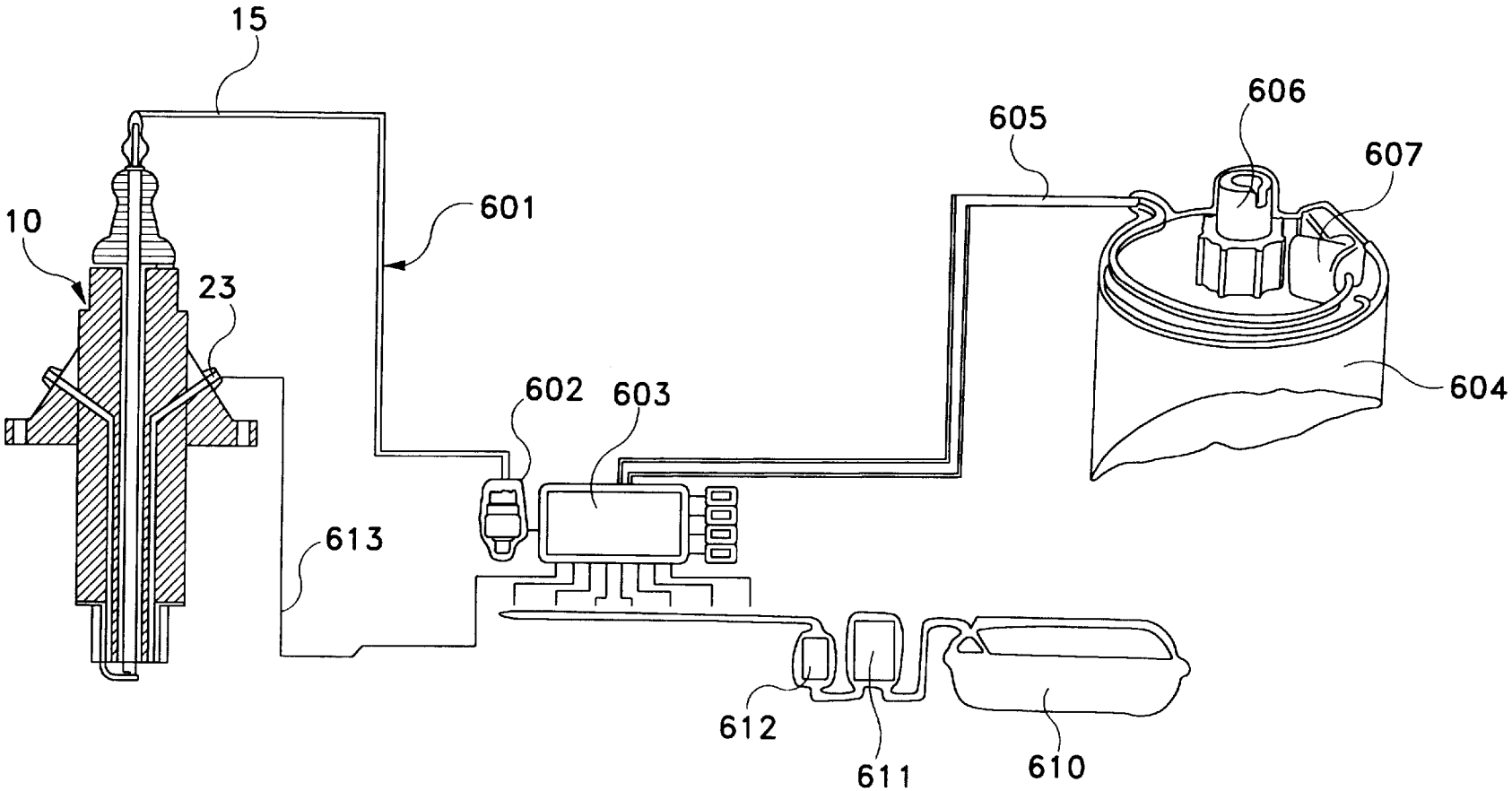
FIG. 6 is a schematic view of the spark plug of FIGS. 1–4 in an internal combustion engine whose ignition and fuel injection are computer controlled.

The schematic system of FIG. 6 shows how spark plug 10 of an embodiment of this invention is operated. The technical specification of the spark plug 10 when used in the internal combustion engine of FIG. 6 is as follows:

| PLASMA GENERATOR | |
|---|---|
| Input voltage | 13.2 to 12.6 volts |
| Negative Ground Only | — |
| Current Draw (Switched On) | 1 to 3 Amps |
| Current Draw (DC) | 7.2 Amps |
| Plasma Generator Output Voltage | 3.7 KV |
| Capability of Current Arc | 96 MA |
| Energy for Electrode Plug (where the present conventional system capability of current arc is MA 18) | 268 MJ (approx.) |
| Crank Angle Duration | 20° to 40° |
| Length | 4¾" = 12 cm. |
| Height | 2" = 5 cm. |
| Width | 3¾" = 9.5 cm. |
| Weight | 1 lb. 9 ozs. = .4792 Kg. |
| Coil | — |
| Primary Resistance | 1.9 Ohms |
| Secondary Resistance | 11.2 Ohms |
| Primary to Secondary Insulation | 13.8 KV |
| Max. Energy Output | 478.9 MA |
| Max. Volts Output | 46,000 Volts |

-continued

| PLASMA GENERATOR | |
|---|---|
| Input voltage | 13.2 to 12.6 volts |
| Diameter | 3⅞" = 9.52 cm. |
| Height | 6" = 15.3 cm. |
| Weight | 3.2 lb. = 1.431 Kg. |
| NSP Combustion Chamber Volume | 467 to 900 cu/mm. |
| Synchro-Fuel Pressure | 19 to 105 PSI |

As seen in FIG. 6, terminal connector pin is connected via electrically-conductive leads 601 to a distributor 602. The distributor 602 is controlled by a computer 603, which monitors manifold pressure, engine speed, engine temperature, and air temperature. The electronic ignition includes a coil 604 having wires 605 connected to the control unit of the computer 603. The ignition also includes a reluctor or reluctance pick-up coil 606 and a permanent magnet 607.

The manner of operation of the electronic ignition is as follows:

The rotating reluctor and magnetic pick-up is used in place of the traditional cam breaker points of the conventional electronic ignition of automobiles. The system used in the present invention reduces the time between tune-ups. The high spots of the reluctor interrupts the magnetic field of the electric coil and permanent magnet. These interruptions or pulses are transmitted from the coil in a nearby electronic control unit. The pulses signal a transistor to break the voltage sub-circuit and to release high voltage from the coil to the terminal 10 of the injector spark plug 10.

The computer 603 also controls the fuel injection system from the fuel tank 610 through the fuel pump 611 and fuel filter 612, while making obsolete the traditional injection nozzles, and carburetor. The fuel injection system is controlled by the computer in the following manner.

In the present invention, the engine dispenses with the carburetor and substitutes a compact computer to provide more precise fuel mixtures in an a fuel injection system. According to the present invention, the computer 603 decides how much fuel is needed and meters the proper amount into a series of injector spark plugs 10 of an embodiment of the present invention through fuel line 613. The injector spark plugs 10, on further command from the computer 603, provides individual sprays for each cylinder directly without loosing volume or pressure in its path, therefore reducing gas or fuel consumption by a minimum of 72%. In the conventional systems, the carburetors waste fuel by providing a single, voluminous spray for all cylinders at once, with only 18% of that fuel or gas being burned by any engine. The separate mixing of air and fuel takes place at the bottom of the injector spark plug 10. Fuel is fed individually to each cylinder and is not fed to the intake manifold. Every time the driver steps on the gas pedal he triggers a new series of computer calculations. The pedal opens a yoke comparable to the carburetor's choke that increases the volume of air entering the engine's injector spark plugs. The computer instantly reacts to the increased air flow in the air duct, comparing it to the engine speed and power required as well as to the temperatures of both the outgoing and the incoming air, and then calculates the proper fuel mixture and directs a spray of gasoline toward each cylinder. Combustion is virtually 100% efficient.

Figure 7:
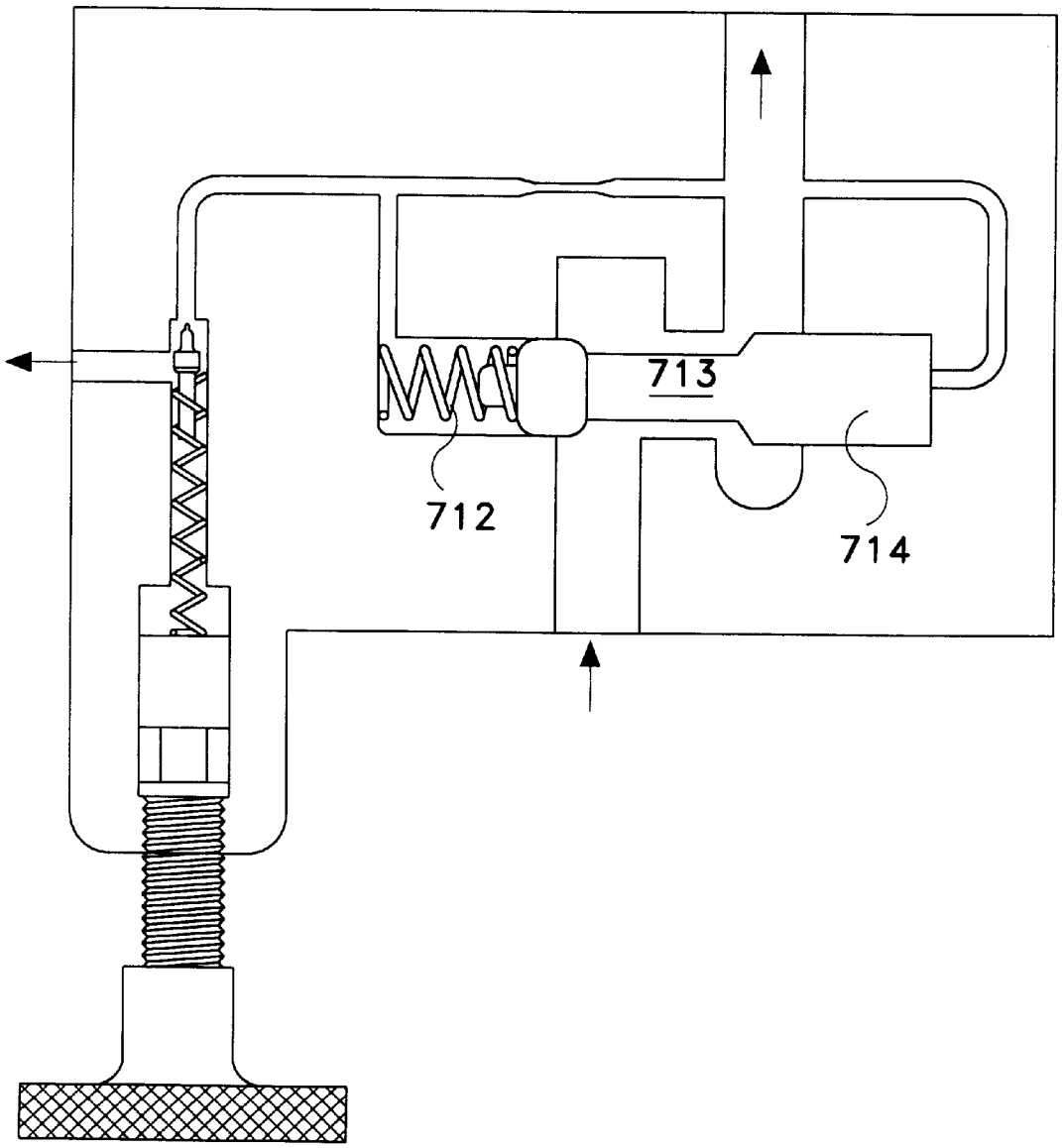
FIG. 7 is a schematic representation of a pressure reducing valve used in the internal combustion engine whose ignition and fuel injections are computer controlled as shown in FIG. 6.

One version of a pressure-reducing valve, used in an embodiment of this invention, is shown in FIG. 7. Reduced pressure is obtained by restricting the flow to the low pressure circuit. As pressure rises, the piston 710 is moved and compresses the spring 712. The shape of the piston 710 restricts the passage orifice 713.

While one embodiment has been chosen to illustrate the invention, it will be understood by those skilled in the art that various changes and modifications can be made therein without departing from the scope of the invention as defined in the appended claims.

What is claimed is:

1. A spark plug, comprising:

an insulator body having a longitudinally-extending through bore;

a one-piece, central electrode secured within said longitudinally-extending through bore and providing an annular zone for communicating with combustion chamber;

an earth lower electrode projecting towards said central electrode and spaced a longitudinally-fixed distance beyond a lower end of said central electrode;

a first, non-central, longitudinally-extending bore within said insulator body for connection to a fuel metering device for controllably admitting fuel to the combustion chamber;

a second, non-central, longitudinally-extending bore within said insulator body for connection between said combustion chamber and an exhaust manifold to exhaust gases from the combustion chamber; and a lower-threaded base for connection to an opening in the combustion chamber.

2. A spark plug according to claim 1 wherein said insulator is formed of porcelain, ceramic or mica.

3. A spark plug according to claim 1 wherein said central electrode is formed of nichrome, in a piezzo-electric material or of a platinum-group metal.

4. A spark plug according to claim 3 wherein the lower end of said central electrode extends diametrically-outwardly.

5. A spark plug according to claim 1 wherein said lower electrode is formed of a platinum group metal.

6. A spark plug according to claim 1 wherein said lower threaded base is formed of aluminum, and includes an upper copper gasket adjacent a lower end of said insulator body.

7. An internal combustion engine, comprising:

at least one cylinder with an intake valve, a spark plug connected to said cylinder, said spark plug including an insulator body having a longitudinally-extending through bore, a one-piece, central electrode secured within said longitudinally-extending through bore and providing an annular zone communicating with a combustion chamber of said cylinder, an earth lower electrode projecting radially-inwardly towards said central electrode and spaced a longitudinally-fixed distance beyond a lower end of said central electrode, a first, non-central, longitudinally-extending bore within said insulator body connected to a fuel metering device for controllably admitting fuel to within said combustion chamber, a second, non-central, longitudinally-extending bore connected between said combustion chamber and an exhaust manifold to exhaust gases from said combustion chamber, and a lower-threaded base connected to an opening in said combustion chamber;

a computerized ignition control connected to a terminal of said central electrode of said spark plug; and a computerized micro pulsation delivery fuel line connected to said first, non-central longitudinally-extending bore.

8. An internal combustion engine according to claim 7 wherein said computerized ignition control includes a distributor controlled by a computer which monitors manifold pressure, engine speed, engine temperature and air temperature, said ignition control including a rotating reluctor and a magnetic pick-up to produce control pulses.

9. An internal combustion engine according to claim 8 wherein said fuel injection system is configured to provide a precise mixture of fuel and air directly to a fuel injection port of said spark plug, thereby to provide individual sprays of fuel/air mixture to the associated cylinder without losing volume and/or pressure in a path thereof.

10. An internal combustion engine according to claim 7 wherein said fuel injection system is configured to provide a precise mixture of fuel and air directly to a fuel injection port of said spark plug, thereby to provide individual sprays of fuel/air mixture to the associated cylinder without losing volume and/or pressure in a path thereof.

11. An internal combustion engine according to claim 7 wherein said combustion chamber has a volume of 467 to 900 $mm^3$.

12. An internal combustion engine according to claim 7 wherein a plurality of cylinders with combustion chambers are provided; and one said spark plug is connected to each of said combustion chambers;

whereby said micropulsation delivery fuel line delivers fuel to each of said combustion chambers through said spark plugs individually an d sequentially.

13. A combustion apparatus, comprising:

at least one combustion chamber;

a spark plug connected to said chamber, said spark plug including an insulator body having a longitudinally-extending through bore, a one-piece, central electrode secured within said longitudinally-extending through bore and providing an annular zone communicating with said combustion chamber, an earth lower electrode projecting radially-inwardly toward said electrode and spaced a longitudinally-fixed distance beyond a lower end of said central electrode, a first, non-central, longitudinally-extending bore within said insulator body connected to a fuel metering device for controllably fuel to within said combustion chamber, a second, non-central, longitudinally-extending bore connected between said combustion chamber and an exhaust manifold to exhaust gases from said combustion chamber, and a lower-threaded base connected to an opening in said combustion chamber;

a computerized ignition control connected to a terminal of said central electrode of said spark plug; and a computerized micro pulsation delivery fuel line connected to said first, non-central longitudinally-extending bore.

14. A combustion apparatus according to claim 13 wherein said combustion chamber is a furnace.

* * * * *